US005139827A

United States Patent [19]

Faigel

[11] Patent Number: 5,139,827

[45] Date of Patent: Aug. 18, 1992

[54] STATUE

[76] Inventor: Oleg Faigel, 8 Apple Tree La., Woodbridge, Conn. 06525

[21] Appl. No.: 538,658

[22] Filed: Jun. 15, 1990

[51] Int. Cl.[5] ..... A63H 13/00; B44C 3/06

[52] U.S. Cl. ..... 428/542.2; 40/414; 40/419; 428/16; 446/354; 446/362

[58] Field of Search ..... 446/336, 353, 354, 362; 428/7, 16, 542.2; 40/414, 419

[56] References Cited

U.S. PATENT DOCUMENTS

| | | | |
|---|---|---|---|
| 2,366,576 | 1/1945 | Thomas | 446/353 |
| 2,414,179 | 1/1947 | Thomas | 446/336 X |
| 2,633,669 | 4/1953 | Churus | 446/353 |
| 3,227,825 | 1/1966 | Pullen | 446/354 X |
| 3,703,048 | 11/1972 | Cooper | 446/336 |
| 4,006,555 | 2/1977 | England et al. | 446/354 X |
| 4,750,900 | 6/1988 | Hart | 446/336 X |

*Primary Examiner*—Henry F. Epstein
*Attorney, Agent, or Firm*—Ilya Zborovsky

[57] ABSTRACT

A statue has a body with at least one raisable and lowerable extremity, and a motor drive connected with the extremity through a counterweight, so that the extremity is lowered under the action of its own weight and raised by the motor drive with the assistance of the counterweight.

6 Claims, 3 Drawing Sheets

STATUE

BACKGROUND OF THE INVENTION

The present invention generally relates to statues, and in particular to such statues which have movable extremities.

Statues of the above mentioned general type are known in the art. An extremity is lifted and lowered in the known statues under the action of a motor drive which is positively connected with a respective extremity, for example an arm of the statue. This construction possesses some disadvantages. The motor drive must develop in this case a moment which is equal to a moment required for the lifting of the extremity. For statues of big sizes the moment required for lifting of the extremities is very high, and therefore it requires a very high power of the motor drive.

SUMMARY OF THE INVENTION

Accordingly, it is an object of the present invention to provide a statue with a liftable and lowerable extremity, which avoids the disadvantages of the prior art.

More particularly, it is an object of the present invention to provide a statue with liftable and lowerable extremities, in which a significantly lower power of a motor drive is required for the operation of the respective extremity.

In keeping with these objects and with others which will become apparent hereinafter, one feature of the present invention resides, briefly stated, in a statue, which has a body, at least one extremity, a motor drive for lifting the extremity, and a counterweight arranged so that during the operation of the motor drive the extremity is lowered under the action of its own weight, while the lifting of the extremity is performed by the motor drive with assistance of the counterweight which during the lifting of the extremity applies a force directed downwardly and additionally pulling the extremity upwardly.

When the statue is designed in accordance with the present invention, it eliminates the disadvantages of the prior art. More particularly, with the presence of the counterweight, the power of the motor drive is reduced, the required moment for lifting of the extremity is reduced as well, and the size of the motor drive is reduced.

The novel features of the present invention are set forth in particular in the appended claims. The invention itself, however, both as to its construction and its manner of operation will be best understood from the following description of a preferred embodiment which is accompanied by the following drawings.

DESCRIPTION OF A PREFERRED EMBODIMENT

Figure 1:
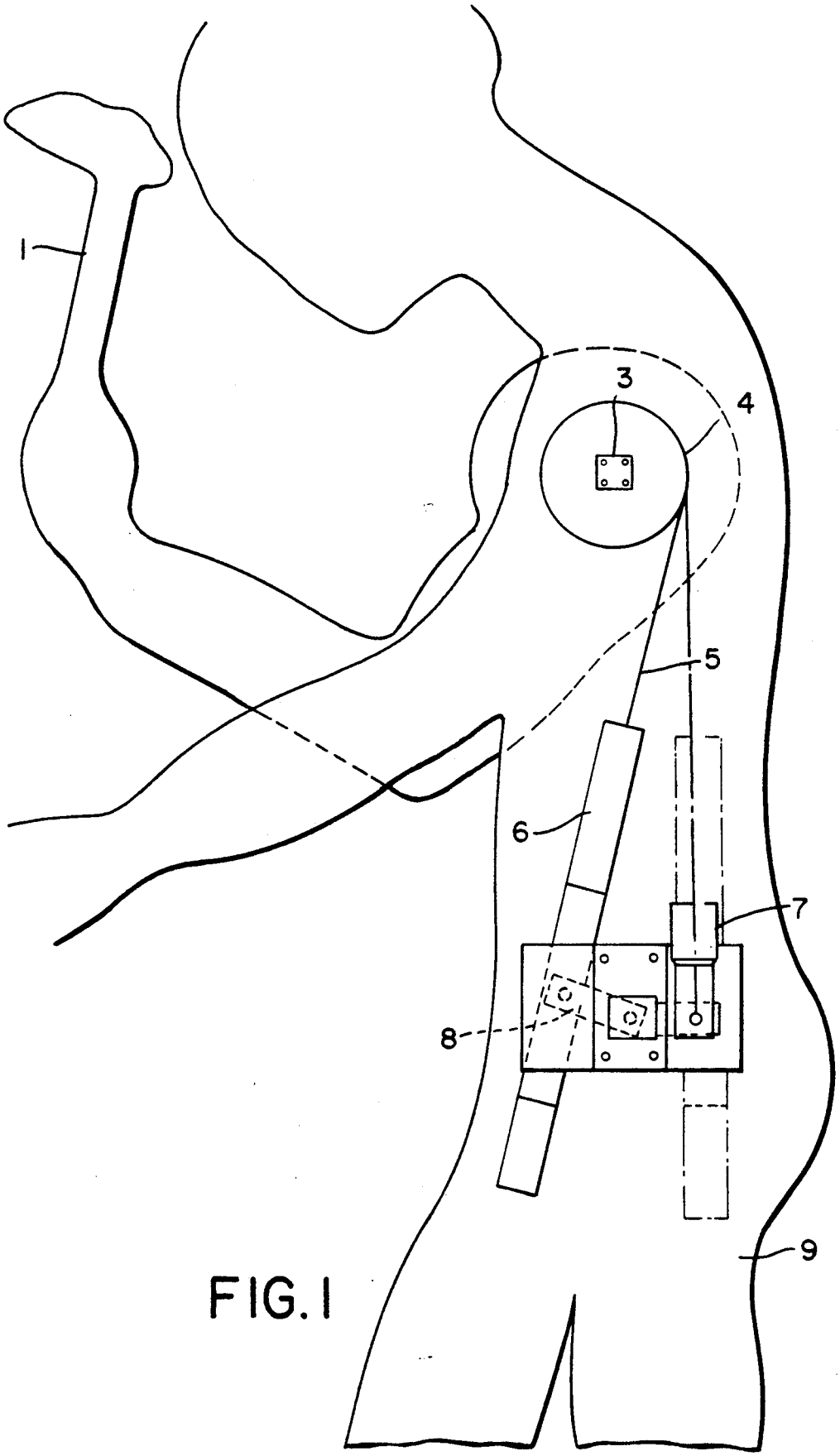
FIG. 1 is a side view of a statue in accordance with the present invention.
Figure 2:
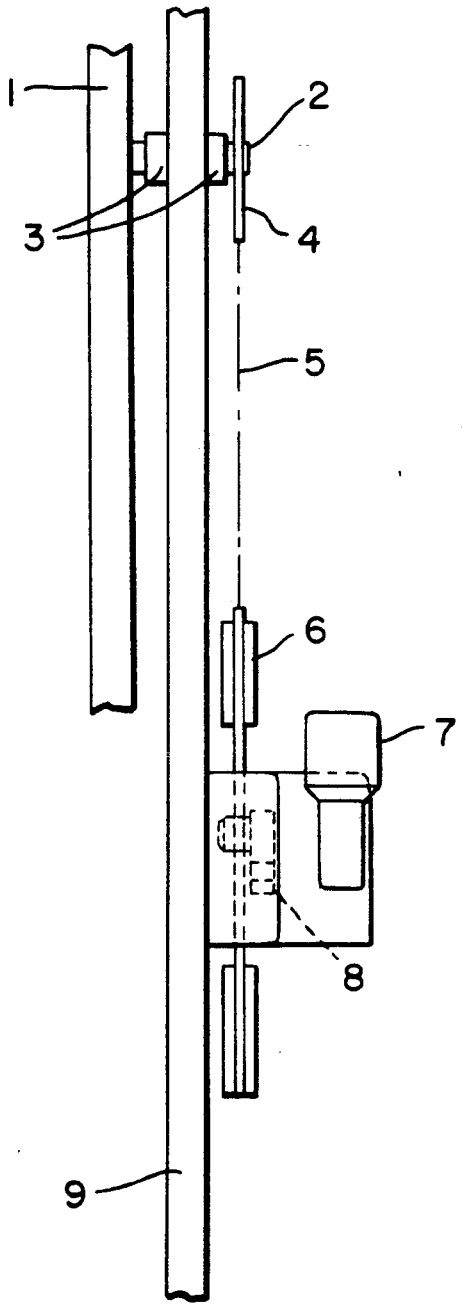
FIG. 2 is a schematic end view of a mechanism for lifting and lowering of an arm of the statue of FIG. 1 in accordance with the present invention.
Figure 3:
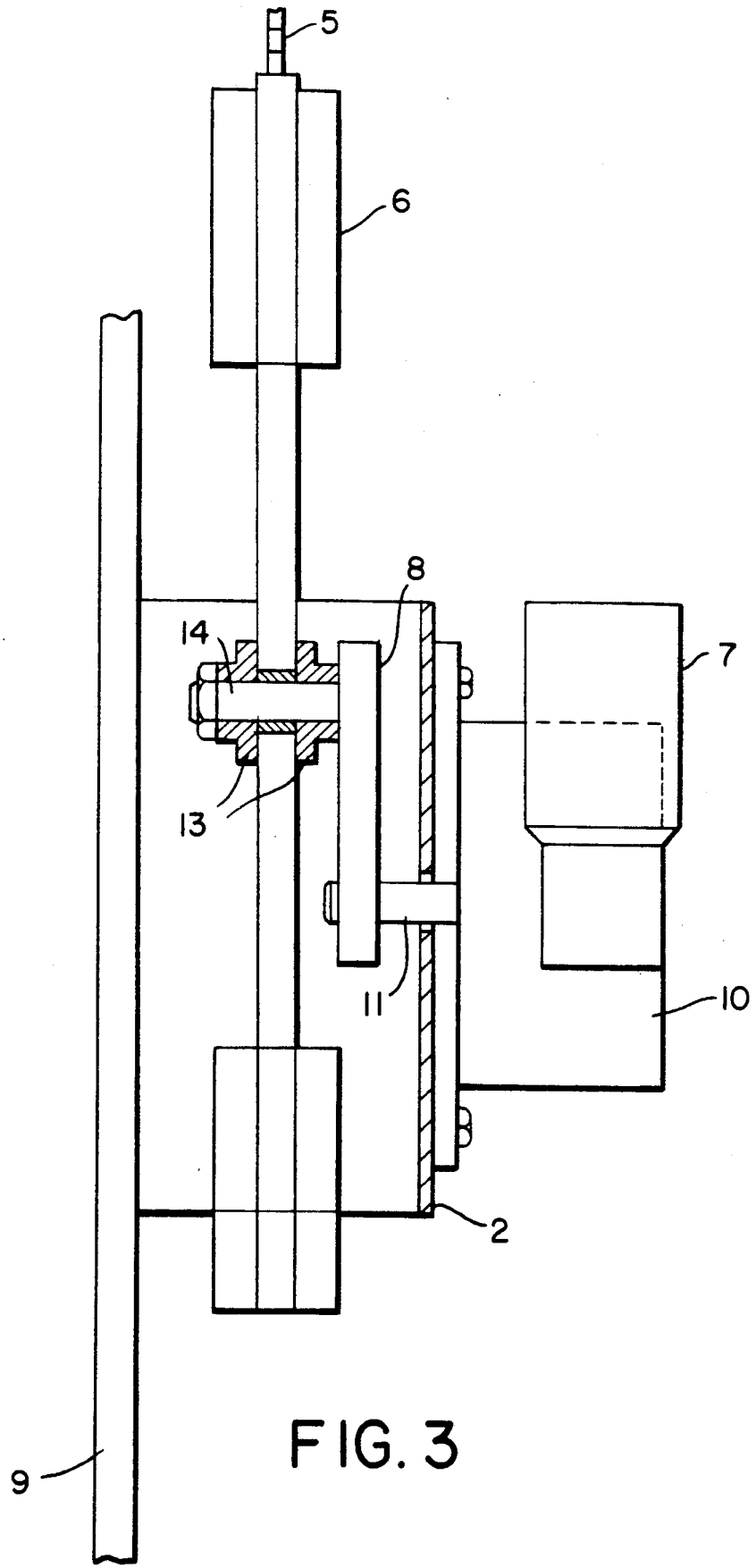
FIG. 3 is a schematic end view of a portion of the mechanism of FIG. 2 on a somewhat enclarged scale.

A statue in accordance with the present invention has a body identified as a whole with reference numeral 9 and at least one arm which is liftable and lowerable and identified with reference numeral 1.

The statue is provided with a motor drive which includes an electric motor 7 with a worm reducer 10. The output shaft 11 of the reducer 10 is connected with one end of a crank 8, while the opposite end of the crank 8 is provided with an axle 14. A counterweight 6 has bearing supports 13 which are fixedly connected with the counterweight and on the other hand are rotatably supported on the axle 14 of the crank 8.

The motor 7 and the reducer 10 are fixedly mounted on a frame 12 which is fixedly connected, for example welded to the body 9 of the statue. A axle 2 is rotatable in supports 3 fixedly mounted on the body 9 of the statue. The arm 1 is connected with the axle 2 for joint rotation therewith. A pulley 4 is also arranged on the axle 2 and connected by a chain or cord 5 with the counterweight 6.

The statue and more particularly it arm 1 operates in the following manner:

When the electric motor 7 is turned on, the arm 1 is lifted through the worm reducer 10, the crank 8, the counterweight 6, the chain 5 and the pulley 4. During lifting of the counterweight 6, the chain 5 is released and the arm 1 lowers under the action of its own weight. Then the counterweight 6 is lowered, the chain 5 turns the pulley 4, and the arm 1 is lifted. The lifting and lowering of the counterweight is performed during one revolution of the crank. The same is true for the lifting and lowering of the arm 1. The moment to be delivered by the drive of the statue is thus equal to a difference between the moment of lifting of the arm and the moment of lowering of the counterweight.

The present invention is not limited to the details shown since various modifications are possible without departing in any way from the spirit of the invention.

What is desired to be protected by Letters Patent is set forth in the appended claims:

1. A statue, comprising a body;

at least one extremity arranged movably relative to said body;

a motor drive having an output shaft;

a crank having one end connected with said output shaft and turnable by the latter, and also having another end;

a pulling cord element having one end connected with said extremity and another end; and a counterweight connected with the other end of said crank so as to be lifted and lowered by the latter, said counterweight having an end connected with said pulling cord element so that said motor drive is connected with said extremity through said crank and also through said counterweight which is suspended by said pulling cord element in a substantially upright position and through said pulling cord element, so that lowering of said extremity is performed under the action of its own weight, while raising of said extremity is performed by said motor drive with assistance of said counterweight which applies a force directed downwardly.

2. A statue as defined in claim 1, wherein said extremity has an axle, said body having a support in which said axle is freely turnable.

3. A statue as defined in claim 2; and further comprising a pulley mounted on said axle, said one end of said pulling element being connected with said pulley.

4. A statue as defined in claim 1, wherein said motor drive includes an electric motor and a reducer connected with said electric motor and having an output shaft.

5. A statue as defined in claim 1, wherein said crank is dimensioned so that during one full revolution of said crank said extremity is lowered and raised.

6. A statue, comprising a body;

at least one extremity arranged movably relative to said body so as to be raised and lowered;

a counterweight connected with said extremity so as to urge said extremity to a raised position under the action of weight of said counterweight which applies a force directed downwardly; and a motor drive connected to said counterweight and thereby also connected with said extremity through said counterweight, so that lowering of said extremity is performed under the action of its own weight, while raising of said extremity is performed by said motor drive with assistance of the weight of said counterweight which applies a force directed downwardly.

* * * * *